United States Patent [19]

Kussendrager et al.

[11] Patent Number: 4,594,110

[45] Date of Patent: Jun. 10, 1986

[54] PROCESS FOR PREPARING LACTOSE PRODUCTS

[75] Inventors: Klaas D. Kussendrager, Veghel; Anton C. Andreae, Staphorst, both of Netherlands

[73] Assignee: DMA-Campina B.V., Netherlands

[21] Appl. No.: 597,177

[22] Filed: Apr. 5, 1984

[30] Foreign Application Priority Data

Apr. 7, 1983 [NL] Netherlands ..... 8301220

[51] Int. Cl.[4] ..... C13K 5/00

[52] U.S. Cl. ..... 127/31; 127/58; 127/63

[58] Field of Search ..... 127/31, 34, 42, 46.1, 127/58, 61, 63, 52

[56] References Cited

U.S. PATENT DOCUMENTS

| | | | |
|---|---|---|---|
| 2,182,619 | 12/1939 | Sharp et al. | 127/31 |
| 2,319,562 | 5/1943 | Sharp | 127/31 |
| 3,511,226 | 5/1970 | Kyle et al. | 127/58 |
| 4,076,552 | 2/1978 | Farag et al. | 127/52 X |
| 4,083,733 | 4/1978 | Asano et al. | 127/63 X |
| 4,280,997 | 7/1981 | Van Leverink | 127/63 |

OTHER PUBLICATIONS

Bell, R. W.; "Some Methods of Preparing Quickly Soluble Lactose", *Industrial Engineering Chemistry*, Jan., 1930, pp. 51–54, vol. 22, No. 1.

Hocket, et al.; A Novel Modification of Lactose, Journal of Am. Chem. Society, vol. 53, (1931) pp. 4455–4456.

*Primary Examiner*—Richard V. Fisher
*Assistant Examiner*—W. Gary Jones
*Attorney, Agent, or Firm*—Scully, Scott, Murphy & Presser

[57] ABSTRACT

A process for preparing stable anhydrous lactose products comprising the compound crystal form of the alpha form and the beta form of lactose. An unstable anhydrous lactose product is heated, at atmospheric or subatmospheric pressure, at low water vapor pressure, and while avoiding overheating, to a temperature in the range of from 100° C. to 220° C., and the product is kept at that temperature until crystallization of the compound crystal form of the alpha form and the beta form of lactose occurs.

7 Claims, 1 Drawing Figure

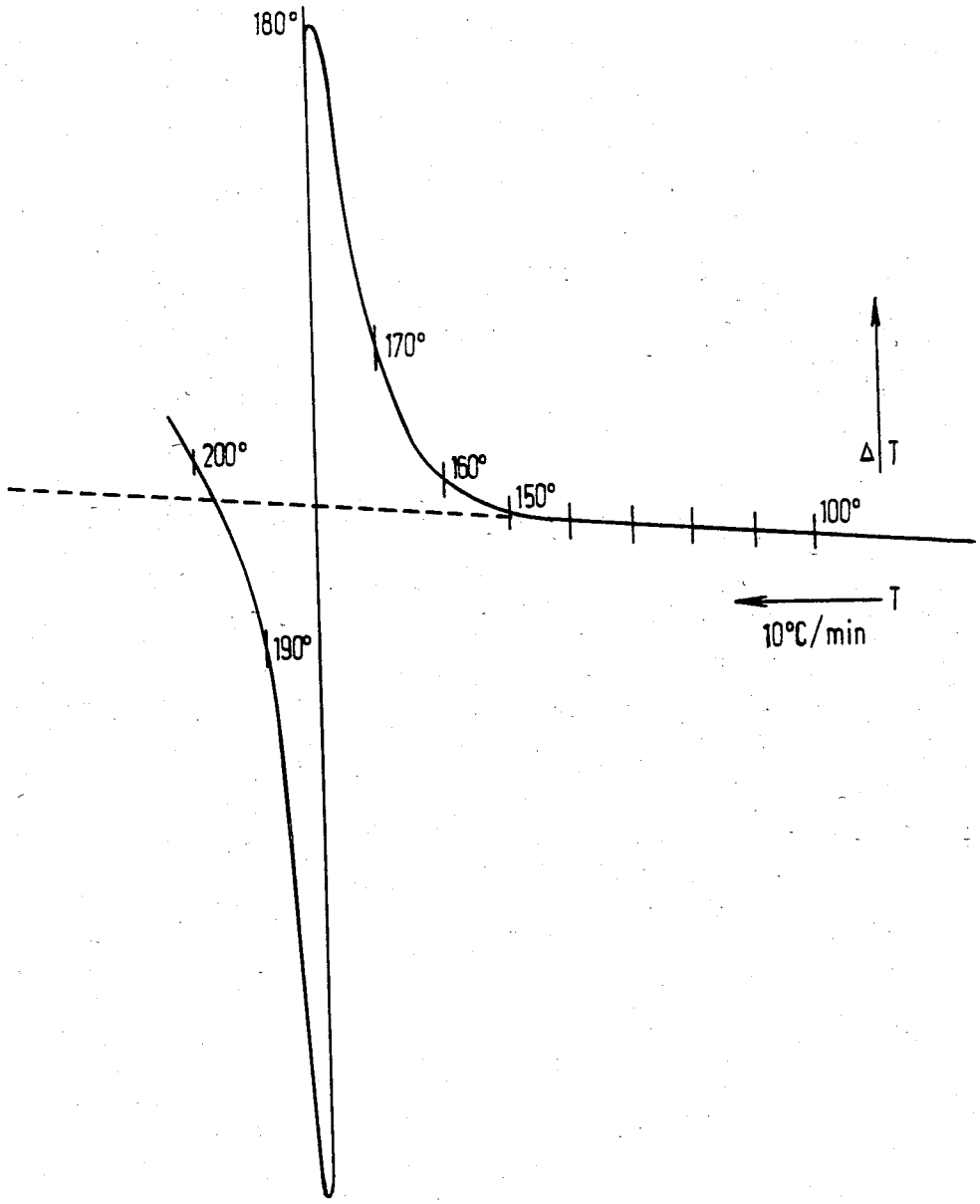
180°
170°
160°
150°
100°
200°
190°
ΔT
T
10°C/min

PROCESS FOR PREPARING LACTOSE PRODUCTS

This invention relates to a process for preparing stable anhydrous lactose products comprising the compound crystal form of the alpha form and the beta form of lactose. The preparation of the compound crystal form of alpha-lactose and beta-lactose by crystallization from methanol or other organic solvents is described by Hockett and Hudson in Journal of the American Chemical Society 33 (1931) 4455–4456. The compound crystal form are reported to contain 5 molecules of the alpha form and 3 molecules of the beta form, i.e. exhibiting a ratio by weight of 37.5/62.5 between the beta and the alpha form. Other authors, such as Buma in Het Nederland Melk en Zuiveltijdschrift (Netherlands Milk and Dairy Journal) 32 (1978) 258–261, find the compound crystal form with different ratios between beta and alpha form, namely, 54/46 and 45/55. U.S. Pat. No. 3,511,226 describes a process in which skim milk powder or whey powder is extracted with methanol, and lactose is separated from the extract by crystallization. Although the form in which this lactose is produced is not specified in the patent, it can be supposed, on the ground of the method of preparation, that the product is an anhydrous compound crystal form of the alpha and the beta form of lactose, as is the case in the literature mentioned above.

As at least four crystalline anhydrous forms of lactose are known, in addition to amorphous anhydrous forms, a clear distinction should be made between, on the one hand, mixtures of crystalline alpha-lactose and crystalline beta-lactose in which each of the isomeric forms exhibits its own crystal lattice, and on the other hand, the compound crystal form in which both forms together occur in the same crystal lattice. In addition the compound crystal form of the alpha form and the beta form or the well-known alpha-lactose hydrate, the other crystalline lactose forms are (anhydrous) beta-lactose, stable anhydrous alpha-lactose and unstable anhydrous alpha-lactose. The instability relates to the fact that the product has a hygroscopic behaviour even at moderate air humidity, and absorbs moisture to form the alpha-lactose hydrate. Both beta-lactose and anhydrous stable alpha-lactose can be called metastable, because at room temperature and high humidity, in particular after being dissolved, they pass into the most stable form, the alpha-lactose hydrate. The differences in crystal lattice are accompanied by other differences in physical properties, by which the various forms can be distinguished. Thus Buma, in the above article, concludes from the homogeneous specific gravity of the product he obtained that it was not a mixture of two different forms, but a real compound crystal form.

U.S. Pat. No. 2,319,562 mentions a number of manners of making crystalline anhydrous lactose products, in particular the stable form of alpha-lactose anhydride, but also the formation of unstable anhydrous alpha-lactose and of beta-lactose, as described, inter alia, in U.S. Pat. No. 2,182,619, are mentioned in this patent. The starting product is alpha-lactose hydrate, which is heated in an autoclave under controlled conditions of humidity at temperatures of 100°–190° C. with the unstable alpha form being produced under a vacuum at a low water vapour pressure, and the beta form at high water vapour pressure. At water vapour pressures of between 6 cm and 80 cm Hg, the stable alpha form of lactose is formed.

U.S. Pat. No. 4,083,733 describes the preparation of products designated beta-lactose by mixing alpha-lactose hydrate with 1.5 to 15% of water and extruding the mixture, whereafter the residual moisture is removed by drying at temperatures above 93° C. Some of the products thus produced only contain 40% of the lactose in the beta form, so that the balance is in the alpha form, while it may be assumed that, in view of the moisture content, which in that case is generally above 1.5%, at least a considerable part thereof is the well-known alpha-lactose hydrate.

Processes in which lactose can be produced in the form of the compound crystal form of the alpha form and the beta form of lactose without using organic solvents are as yet unknown. The use of solvents, such as ethanol, methanol and the like is not so attractive, because the residues of the solvent must be thoroughly removed from the product for it to be suitable as a food or for pharmaceutical purposes. In the recovery of the solvent, losses occur, which increases the cost of the process. In connection with its inflammability, particular precautionary measures are required.

It has now been found that, without the use of organic solvents, and hence without the above disadvantages, stable anhydrous lactose products comprising the alpha form and the beta form of lactose can be prepared by heating up an unstable anhydrous lactose product at atmospheric or sub-atmospheric pressure and at low water vapour pressure, and while avoiding overheating, to a temperature in the range between 100° C. and 220° C., and keeping the product at that temperature for such a period of time that crystallization of the compound crystal form of the alpha form and the beta form of lactose occurs.

The unstable anhydrous lactose product may be the unstable crystalline form of alpha-lactose as well as an amorphous mixture of the alpha form and the beta form or amorphous alpha- or beta-lactose. Other possible starting products are lactose solutions, which are first dried so that no crystallization occurs and an amorphous anhydrous lactose product is formed. The process according to the invention can also be carried out starting from alpha-lactose hydrate by first drying this raw material in known manner, for example, under the conditions mentioned in U.S. Pat. No. 2,319,562, to form unstable anhydrous alpha-lactose, and subsequently continuing the heat treatment until the product fully passes into the compound crystal form. At high water vapour pressure, for example, at a water vapour pressure in excess of 80 cm Hg, the heat treatment may lead to the undesirable formation of beta-lactose crystal. Heating the stable or metastable products, beta-lactose crystal or alpha-lactose anhydride in the stable form does not lead to a conversion into the compound crystal form according to the present invention.

Heating should be carried out so as to avoid overheating, which means that heat must be supplied at such a rate that the parts of the product located closest to the heat source must never be able to get a temperature considerably in excess of that of the remainder of the product or in excess of the maximum value of 220° C. Heat can be supplied in many ways, for example, by supplying heated air, by heat radiation, by means of microwaves, etc.

The formation of the lactose compound crystal form according to the invented process has been found to proceed rapidly and with little side-reactions in particular in the range of 150° to 180° C. As is well-known, sugars, such as lactose, when heated in dry condition may decompose while splitting off water, which may first lead to the formation of anhydrous sugars or glycans, and later to hydroxymethyl furfural and decomposition products thereof, which impart a brown colour to the product by caramelization. To avoid this, the total heating period in preparing the lactose compound crystal form must be limited, and preferably be no longer than 30 minutes.

By avoiding heating the product in an oxygen-containing atmosphere, the discoloration can be somewhat delayed. Specific compounds having a negative catalytic effect, as for example sulphur dioxide, in the atmosphere in which lactose is heated in accordance with the present invention has been proved to be capable of suppressing the formation of brown and black colours.

Products of the process according to the invention contain the alpha form and the beta form of lactose in approximately equal proportions. As is plausible from the older literature references, however, a slight excess of one of the two forms may be present without the product consisting of a mixture of two different crystal types, as may be apparent, for example, from the specific gravity in sedimentation tests. The X-ray diffraction pattern of the compound crystal form shows a clearly different picture from both the crystals of pure beta-lactose and of those of pure alpha-lactose in the stable or unstable form. In other physical characteristics, such as for example the heat content, as shown by differential thermal analysis, the compound crystal form is distinguished from other crystalline lactose forms. In these characteristics, the compound crystal form produced by the process according to the invention correspond with the compound crystal form produced by the crystallization of lactose from methanol solutions. In the condition of equilibrium, the solubility in water is the same for all lactose forms, because owing to muta-rotation, there is always formed the same mixture between the alpha and the beta form. The compound crystal form, however, like the other anhydrous lactose forms, are more rapidly dissolved than the alpha-lactose hydrate. In addition, after dissolution, the equilibrium ratio between the alpha form and the beta form is set more rapidly than when dissolving one of the crystalline lactose products comprising only one stereo-isomeric form only. As a result, the properties of the products prepared according to the present invention can be put to good use for producing effects in medicinal or food applications which with the other lactose forms cannot be realized, or less effectively, without replacing the typical properties of lactose by those of another substance, for example, a different sugar or carbohydrate, such as glucose, maltodextrin, starch, cellulose or inorganic substances, etc.

The process according to the invention is illustrated in and by the following examples.

EXAMPLE I

Unstable crystalline anhydrous alpha-lactose was subjected to differential thermal analyses (DTA or DSC). The material had been produced by dehydrating alpha-lactose hydrate in a vacuum drying stove by heating in an atmosphere of 100° to 130° C. for 2 hours. Gas-liquid chromatography (GLC) showed that the raw material contained approximately 8% lactose in the beta form. At 50% relative humidity and at a temperature of 20° C., the raw material rapidly absorbed 5% moisture, which showed its instability. Its crystallinity was shown by X-ray diffraction analysis.

In a DSC oven, a 10 mg sample of the raw material was heated at a rate of 10° C./minute, while a thermogram was taken. The FIGURE shows the thermogram produced. The rise of the line at about 160° C. to 180° C. means an endothermic effect, which is indicative of a softening or melting of the original crystalline material. The descent of the line above 180° C. means an exothermic effect connected with the release of heat of crystallization. The muta-rotation reaction is accompanied by slight changes in heat contents only, so that, owing to the much larger effects of melting and crystallization, this reaction does not become visible. A rise of the beta-lactose content to a value equal to that of alpha-lactose could be demonstrated by gas-liquid chromatography. The X-ray diffraction pattern of the product heated to above 190° C. corresponded with that of products produced by the crystallization of lactose fro methanol.

EXAMPLE II

The same raw material as in Example I, unstable crystalline anhydrous alpha-lactose, was placed in a drying stove kept at a constant temperature of 180° C. After a 10 minutes' residence time in this atmosphere, the product was found not to be markedly discoloured. DSC analysis did show that it was fully converted into a stable form containing approximately 37% beta-lactose. In X-ray analysis, the product gave the picture of the compound crystal form of the alpha form and the beta form of lactose.

EXAMPLE III

Amorphous lactose preparations with various ratios between alpha form and beta form were produced by:

(a) spray drying a solution of lactose, which gave a product containing 40% beta-lactose and 60% alpha-lactose;

(b) freeze drying mixture of a cold-dissolved beta-lactose and cold-dissolved alpha-lactose hydrate. This produced products with a series of various beta contents.

In X-ray analysis, all products behaved as amorphous lactose glass. At a relative humidity of approximately 50%, they were shown to be highly hygroscopic. 10 mg samples of the above products were heated in a DSC oven to increasing temperatures of 100° to 200° C. After cooling, the beta-lactose contents were determined. It was found that, irrespective of the content of beta-lactose in the starting material, muta-rotation reactions occurred in all samples at temperatures around 140° C., so that the proportions of the beta form and the alpha form were virtually equal, that is to say, approximately 50%. Subsequently, in the range between 155° and 170° C., the products showed an exothermic effect, which was caused by crystallization of the compound crystal form of the alpha and the beta form of lactose.

The beta-lactose contents of the products heated to 200° C. and those of the starting products are listed in the following table:

| % beta-lactose | |
|---|---|
| in raw material | in final product |
| 77.2% | 51.5% |
| 59.6% | 49.5% |

-continued

| % beta-lactose | |
|---|---|
| in raw material | in final product |
| 46.2% | 49.7% |
| 43.0% | 48.5% |
| 40.0% | 47.5% |
| | (NB spray dried a) |
| 26.7% | 47.5% |

EXAMPLE IV

The same raw material as in Example III, amorphous lactose glass produced by spray drying or freeze drying, was placed in a drying stove kept at a constant temperature of 165° C. After a 5 minutes' residence time in these surroundings, the product was found not to be visibly discoloured. DSC analysis did show that it was fully converted into a stable form which, in X-ray analysis, showed the picture of the compound crystal form of the alpha form and the beta form of lactose. A freeze-dried product initially containing 46.2% beta-lactose contained after conversion 53.8% beta-lactose. A spray-dried product initially containing 40.0% of beta-lactose contained after conversion 44.1% bea-lactose. A longer heating period does not change this composition, but the tendency of discoloration increased. If the drying gas in the stove contained a small amount of sulphur dioxide, this discoloration was delayed.

We claim:

1. A process for preparing stable anhydrous lactose products comprising the compound crystal form of the alpha form and the beta form of lactose, characterized by heating an unstable anhydrous lactose product, at atmospheric or sub-atmospheric pressure, at low water vapour pressure, and while avoiding overheating, to a temperature in the range of from 100° C. to 220° C., keeping the product at said temperature until crystallization of the compound crystal form of the alpha form and the beta form of lactose occurs.

2. A process according to claim 1, characterized by previously preparing the unstable anhydrous lactose product by converting alpha-lactose hydrate into unstable anhydrous alpha-lactose.

3. A process according to claim 1, characterized by using as the unstable anhydrous lactose product the unstable form of anhydrous alpha-lactose.

4. A process according to claim 1, characterized by using as the unstable anhydrous lactose product amorphous lactose or lactose glass.

5. A process according to claim 1, characterized by keeping the final temperature in the range of from 150° C. to 180° C.

6. A process according to claim 1, characterized in that the period in which the lactose product is kept at a temperature in excess of 100° C. is limited to 30 minutes.

7. A process according to claim 1, characterized by preparing the product in an atmosphere containing a discoloration inhibiting catalyst.

* * * * *